US005534750A

United States Patent [19]

Theiss et al.

[11] Patent Number: 5,534,750

[45] Date of Patent: *Jul. 9, 1996

[54] INTEGRAL POLEPIECE MAGNETIC FOCUSING SYSTEM HAVING ENHANCED GAIN AND TRANSMISSION

[75] Inventors: Alan J. Theiss, Redwood City; Douglas B. Lyon, San Carlos, both of Calif.

[73] Assignee: Litton Systems, Inc., Woodland Hills, Calif.

[ * ] Notice: The portion of the term of this patent subsequent to Jul. 6, 2011, has been disclaimed.

[21] Appl. No.: 263,762

[22] Filed: Jun. 22, 1994

Related U.S. Application Data

[63] Continuation-in-part of Ser. No. 882,298, May 13, 1992, Pat. No. 5,332,947.

[51] Int. Cl.[6] ..... H01J 23/087

[52] U.S. Cl. ..... 315/5.35; 315/39.3; 335/210; 335/306

[58] Field of Search ..... 315/5.35, 39.3; 335/210, 306

[56] References Cited

U.S. PATENT DOCUMENTS

| | | | |
|---|---|---|---|
| 3,011,085 | 11/1961 | Caldwell, Jr. | 315/3.5 |
| 3,099,765 | 7/1963 | Meyerer | 315/3.5 |
| 3,188,533 | 6/1965 | Bretting et al | 335/210 |
| 3,711,943 | 1/1973 | James | 29/600 |
| 3,755,706 | 8/1973 | Scott | 315/5.35 X |
| 3,989,978 | 11/1976 | Souseng et al. | 315/3.5 |
| 3,993,924 | 11/1976 | Hanf | 315/3.5 |
| 4,103,207 | 7/1978 | Chaffee | 315/3.5 |
| 4,137,482 | 1/1979 | Caryotakis et al. | 315/5.35 X |
| 4,399,389 | 8/1983 | Fleury et al. | 315/5.35 X |
| 4,409,519 | 10/1983 | Karp | 315/3.5 |
| 4,560,904 | 12/1985 | Wolfram | 315/3.5 |
| 4,578,620 | 3/1986 | James et al. | 315/3.5 |
| 4,586,009 | 4/1986 | James | 333/156 |
| 4,619,041 | 10/1986 | Davis et al. | 29/600 |
| 4,800,322 | 1/1989 | Symons | 315/3.5 |
| 4,931,694 | 6/1990 | Symons et al. | 315/5.39 |
| 4,931,695 | 6/1990 | Symons | 315/5.39 |
| 4,942,336 | 7/1990 | Amboss et al. | 315/535 X |
| 5,304,942 | 4/1994 | Symons et al. | 330/45 |
| 5,332,947 | 7/1994 | Theiss et al. | 315/3.5 |
| 5,332,948 | 7/1994 | True et al. | 315/5.35 X |

FOREIGN PATENT DOCUMENTS

| | | | |
|---|---|---|---|
| 1233065 | 1/1967 | Germany . | |
| 2168537 | 6/1990 | Japan | 315/5.35 |
| 742070 | 12/1955 | United Kingdom . | |
| 1048440 | 11/1966 | United Kingdom . | |
| 1053861 | 1/1967 | United Kingdom . | |
| 1140917 | 1/1969 | United Kingdom . | |

*Primary Examiner*—Benny T. Lee
*Attorney, Agent, or Firm*—Graham & James

[57] ABSTRACT

A focusing system for an electron beam within an RF amplification tube is provided. The focusing system comprises a plurality of magnetic polepieces each having a centrally disposed aperture, and a plurality of electrically conductive non-magnetic plates alternatingly and integrally provided with the polepieces, the non-magnetic plates each having a centrally disposed aperture. The apertures of the polepieces are aligned with the apertures of the non-magnetic plates to provide a beam tunnel through which the electron beam travels. At least one permanent magnet is coupled to the polepieces, the magnet having magnetic flux which flows through the magnetic polepieces to provide an axial magnetic field within the beam tunnel. The diameter of the beam tunnel is selected to be greater than a separation distance between adjacent ones of said polepieces, and the axial magnetic field varies substantially across a cross section of the beam tunnel. The axial magnetic field has a greatest RMS value at an outermost portion of the beam tunnel.

12 Claims, 3 Drawing Sheets

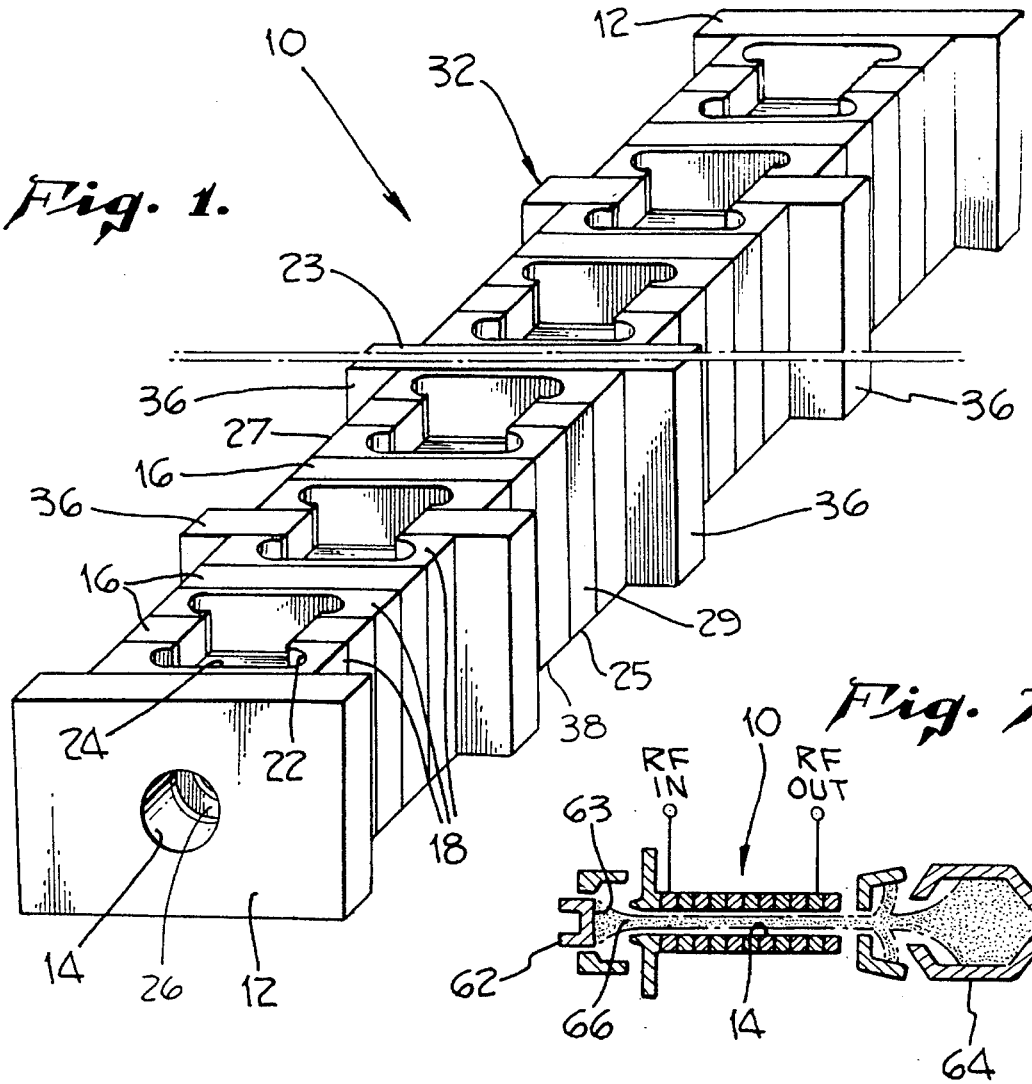
Fig. 1.
Fig. 7.
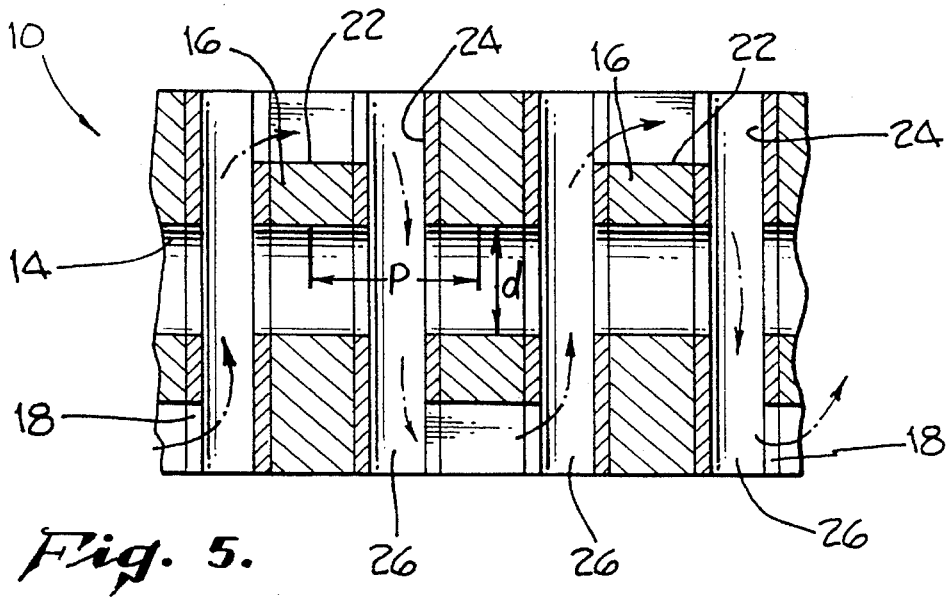
Fig. 5.

10
14
16
18
22
24
26
32
34
42
44
52
5
161
162
163

INTEGRAL POLEPIECE MAGNETIC FOCUSING SYSTEM HAVING ENHANCED GAIN AND TRANSMISSION

RELATED APPLICATION

This is a continuation-in-part of application Ser. No. 07/882,298, filed May 13, 1992, for INTEGRAL POLEPIECE RF AMPLIFICATION TUBE FOR MILLIMETER WAVE FREQUENCIES, issued as U.S. Pat. No. 5,332,947 on Jul. 26, 1994.

BACKGROUND OF THE INVENTION

1. Field of the Invention

The present invention relates to microwave amplification tubes, such as traveling wave tubes or klystrons, and more particularly, to an integral polepiece RF amplification tube having enhanced gain and transmission.

2. Description of Related Art

Microwave amplification tubes, such as traveling wave tubes (TWTs) or klystrons, are well known in the art. These microwave tubes, are provided to increase the gain, or amplify, an RF (radio frequency) signal in the microwave frequency range. A coupled cavity TWT typically has a series of tuned cavities which are linked or coupled by irises formed between the cavities. A microwave RF signal induced into the tube propagates through the tube, passing through each of the coupled cavities. A typical coupled cavity TWT may have up to thirty individual cavities which are coupled in this manner. The meandering path which the RF signal takes as it passes through the tube reduces the effective speed of the traveling signal so that it can be operated upon. The reduced velocity wave formed by a coupled cavity tube of this type is known as a "slow wave."

Each of the cavities is further linked by a beam tunnel which extends the length of the tube. To produce an amplified RF output signal, an electron beam must be projected through the beam tunnel. The beam is guided by magnetic fields which are formed in the tunnel region. The electron beam will interact with the RF signal to produce the desired amplification. The bandwidth of frequencies of the resulting RF output signal can be changed by altering the dimensions of the cavities, and the strength of the RF output signal can be changed by altering the voltage and current of the beam.

The magnetic field which is induced in the tunnel region is obtained from flux lines which flow radially through polepieces from magnets lying outside the tube region. The polepiece is typically made of magnetic material, which channels the magnetic flux to the beam tunnel. This type of electron beam focusing is known as Periodic Permanent Magnet (PPM) focusing. An RF amplification tube can either utilize an "integral polepiece" or a "slip-on polepiece." An integral polepiece forms part of the vacuum envelope extending inward towards the beam region, while a slip-on polepiece lies completely outside the vacuum envelope of the tube. When the polepieces form part of the tunnel as well as the cavity wall, the magnetic flux in the beam region can result in large beam stiffness values, or $\lambda_p/L$ (where "$\lambda_p$" is the wavelength of the plasma frequency of the beam and "L" is the period of the sinusoidal function of the magnetic field in which the beam propagates), a desirable condition for focusing beams. For this reason, integral polepiece RF amplification tubes are preferred over slip-on polepiece tubes.

Klystrons are similar to coupled cavity TWTs in that they can comprise a number of cavities through which an electron beam is projected. The klystron amplifies the modulation on the electron beam to produce a highly bunched beam containing an RF current. A klystron differs from a coupled cavity TWT in that the cavities are not generally coupled. A portion of the klystron cavities may be coupled, however, so that more than one cavity can interact with the electron beam. This particular type of klystron is known as an "extended interaction output circuit."

A significant problem with RF amplification tubes is the efficient removal of heat. As the electron beam drifts through the tube cavities, heat energy resulting from stray electrons intercepting the tunnel walls must be removed from the tube to prevent reluctance changes in the magnetic material, thermal deformation of the cavity surfaces, or melting of the tunnel wall. To remove the heat, copper plates are usually joined to the portion of the magnetic material that conducts the heat to the heat sink. The use of copper lowers the thermal resistance of the heat path and more easily keeps the tunnel temperature below dangerous levels. The minimum thermal path length in typical cylindrical cavities is the radius of the cavity.

An additional problem with RF amplification tubes is that it becomes more difficult to construct them to amplify RF signals in the millimeter wavelength range of the microwave spectrum, or millimeter waves. These extremely short wavelength signals require precise tolerances in the formation of the cavities and the coupling irises. It is well known that in a periodic microwave structure, an increase in the period-by-period variation of the inside dimensions (seen by the RF fields), will result in an increase of RF reflections inside the tube. This, in turn, results in degraded impedance matches between the tube and the RF input waveguide, and lower periodicity values than would otherwise exist. These factors result in reduced gain values achievable by the tube. Thus, as the nominal dimensions of parts decrease with the higher frequencies, the size of the period-by-period variations must also decrease.

In prior art integral polepiece RF amplification tubes, magnetic and non-magnetic parts are usually machined individually, stacked, then brazed together. In tubes designed to operate at millimeter wavelengths, the period-by-period dimensional variations are often determined not only by the tolerances called out for the individual parts, but also by non-uniformities of the braze regions between the parts. At higher frequencies, where more periods and hence more parts are usually required, it becomes more difficult or costly to avoid tolerance build-up along the stack, especially if copper plates must be added to the polepieces to improve the thermal conductivity along the cavity wall.

Consequently, integral polepiece RF amplification tubes become less useful as the operating frequencies and the number of parts increase. More often, the tube is machined out of a single block of copper using discharge machining technique to control the dimension variation problem. Afterwards, a separate magnetic circuit is slipped on and brazed to the tube if light weight PPM focusing is desired. However, by eliminating the integral polepiece, and the consequent introduction of magnetic flux at the tunnel wall, the desirable focusing property of integral polepiece RF amplification tubes has been lost. The ratio of $\lambda_p/L$ is significantly reduced, and only higher beam voltages can be focused.

Another consideration with PPM focusing systems is the relationship between beam tunnel diameter and separation between centers of adjacent polepieces. Generally, a relatively small diameter beam tunnel is desired since it presents better interaction impedance with the electron beam, resulting in greater RF output power and gain. In integral polepiece PPM focusing systems, the iron of the polepiece can extend towards the beam axis so as to form part of the beam tunnel or be very close to the beam tunnel. In such cases, the polepiece geometry typically maintains a ratio of:

$$d/P<1$$

in which d is the diameter of the hole in the iron polepiece (or the beam tunnel diameter) and P is the separation between centers of adjacent polepieces. Slip-on polepiece PPM focusing systems often have a ratio of hole diameter to polepiece separation of greater than one, however, the interior region of the beam tunnel used by the beam is usually near the axis of the system.

In focusing an electron beam, the magnetic field strength at the edge of the beam is of primary significance. Electron beams are often defined in terms of the ratio of the effective radius of the beam and the beam tunnel radius, known as the electron beam "fill factor." An electron beam fill factor of 0.6 is considered typical. PPM focusing systems utilizing the geometric relationship defined above tend to exhibit very small RMS axial magnetic field variation across the beam tunnel diameter. While this is acceptable for ideal electron beams having relatively smooth electron motion with no radial velocity component, imperfect electron beams are not so efficiently focused. An imperfect beam may exhibit electron excursions that impinge on the beam tunnel wall, generating excess heat and reducing the efficiency of the RF amplification tube.

Beam tunnel size also has an effect on the gain achieved by the RF amplification tube. Gain of a propagating RF wave in a traveling wave tube is proportional to the normalized transverse wave number, $\gamma a$, where $\gamma$ is the radial phase constant of the wave, and a is the radius of the circuit on which the RF wave propagates, in this case, a is the radius of the beam tunnel. In PPM focusing systems at high frequencies, a small beam tunnel radius is considered essential for effective interaction between the electron beam and the propagating RF wave, and gain generally decreases when $\gamma a$ becomes too large. The normalized transverse wave number is also proportional to $2\pi/\lambda$, in which $\lambda$ is the wavelength of the propagating RF wave, and is a measure of the size of the RF wave with respect to the beam tunnel. For large values of $\gamma a$, the RF electric and magnetic fields fall off rapidly away from the beam tunnel surface. Thus, in actual practice, PPM focusing systems generally select $\gamma a$ to be less than 2.2 in order to achieve a useful gain level.

Thus, it would be desirable to provide an integral polepiece RF amplification tube for amplifying a millimeter wave RF signal having polepieces extending fully, or at least partially, to the tunnel wall to provide desirable beam focusing. It would also be desirable to provide an integral polepiece RF amplification tube having copper plates in contact with the polepieces along the cavity wall to improve heat removal from the tunnel wall. It would be further desirable to provide a relatively inexpensive method of fabricating an integral polepiece RF amplification tube having the aforementioned features and which eliminates the deleterious effects of tolerance build-up. It would also be desirable to provide an integral polepiece PPM focusing system that has greater RMS magnetic field strength at the outer portion of the beam tunnel for more efficient focusing of the electron beam.

SUMMARY OF THE INVENTION

Accordingly, a principal object of the present invention is to provide an integral polepiece RF amplification tube which amplifies a millimeter wave RF signal, and which has polepieces extending to the tunnel wall for improved beam focusing.

Another object of the present invention is to provide an integral polepiece RF amplification tube which amplifies a millimeter wave RF signal, and which has copper plates in contact with the polepieces along the cavity wall to improve thermal ruggedness and minimize thermal deformation of the cavity surfaces, reluctance variation of the magnetic material and melting of the tunnel wall which could result from high temperature operation.

Yet another object of the present invention is to provide a low cost method for making an integral polepiece RF amplification tube which eliminates the deleterious effects of tolerance build-up.

Still another object of the present invention is to provide an integral polepiece PPM focusing system that has greater RMS magnetic field strength at the outer portion of the beam tunnel for more efficient focusing of the electron beam.

In accomplishing these and other objects, there is provided an RF amplification tube having a laminate structure comprising a plurality of magnetic and non-magnetic plates which are alternatingly and integrally formed together. The structure has substantially planar external surfaces and an internal beam tunnel. A plurality of magnets are provided which form a magnetic field having lines of flux flowing first through the magnetic plates then into the tunnel. The planar surfaces are provided on edges of the structure, and allow for the attachment of planar boundary heat sinks to the circuit. The non-magnetic plates each have one or more slots which provides a resonant cavity after attachment of the heat sinks. The beam tunnel extends through each of the magnetic plates and passes through each of the cavities, permitting projection of an electron beam therethrough. The use of planar configuration would be compatible with the goal of low cost construction, while achieving the needed geometry for the RF amplification. The non-magnetic plates contributes to removal of heat from the structure.

In an embodiment of the invention, a focusing system for an electron beam within an RF amplification tube is provided. The focusing system comprises a plurality of magnetic polepieces each having a centrally disposed aperture, and a plurality of electrically conductive non-magnetic plates alternatingly and integrally provided with the polepieces, the non-magnetic plates each having a centrally disposed aperture. The apertures of the polepieces are aligned with the apertures of the non-magnetic plates to provide a beam tunnel through which the electron beam travels. At least one permanent magnet is coupled to the polepieces, the magnet having magnetic flux which flows through the magnetic polepieces to provide an axial magnetic field within the beam tunnel. The diameter of the beam tunnel is selected to be greater than a separation distance between adjacent ones of said polepieces, and the axial magnetic field varies substantially across a cross section of the beam tunnel. The axial magnetic field has a greatest RMS value at an outermost portion of the beam tunnel.

A more complete understanding of the integral polepiece RF amplification tube for millimeter wave frequencies of the present invention will be afforded to those skilled in the art, as well as a realization of additional advantages and objects thereof, by a consideration of the following detailed description of the preferred embodiment. Reference will be made to the appended sheets of drawings which will be first described briefly.

BRIEF DESCRIPTION OF THE DRAWINGS

FIG. 1 is a perspective view of an integral polepiece RF amplification tube of the present invention;

FIG. 5 is a cross-sectional view of the interior of integral polepiece RF amplification tube, as taken through the Section 5—5 of FIG. 2;

FIG. 7 is a sectional side view of an RF amplification tube assembled to an electron gun and collector.

DESCRIPTION OF THE PREFERRED EMBODIMENTS

This invention provides an integral polepiece RF amplification tube for amplifying a millimeter wave RF signal having polepieces extending fully, or at least partially, to the tunnel wall to provide desirable beam focusing. The integral polepiece RF amplification tube has copper plates in contact with the polepieces along the cavity wall to improve heat removal from the tunnel wall. Moreover, the integral polepiece PPM focusing system has greater RMS magnetic field strength at the outer portion of the beam tunnel for more efficient focusing of the electron beam and greater gain. In the description that follows, like numerals are used to identify individual elements of the invention that are illustrated in one or more of the figures.

Figures 2, 3, 4, 6:
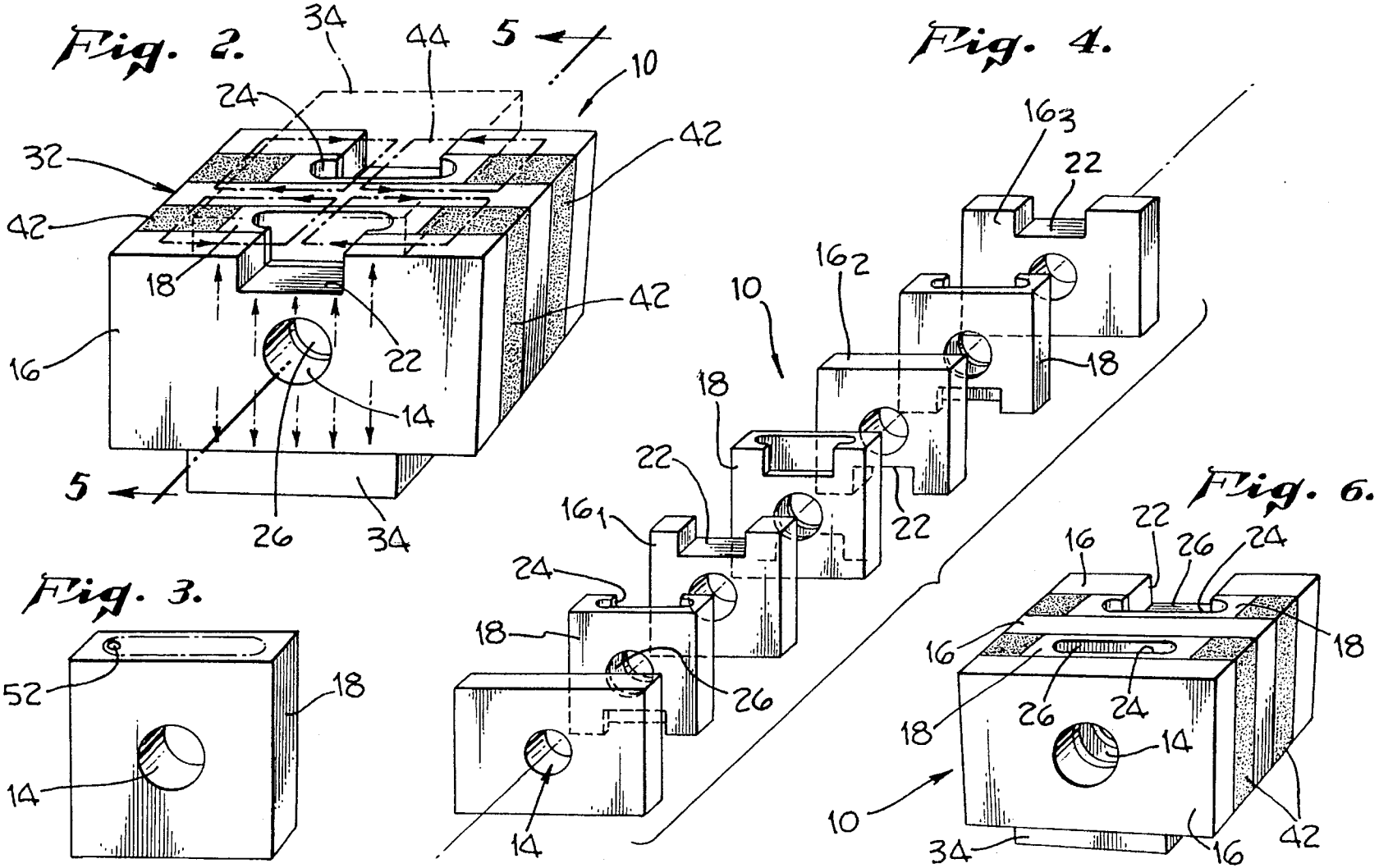
FIG. 2 is a partial perspective view of the integral polepiece RF amplification tube with the magnetic flux lines and the heat flux lines illustrated.
FIG. 3 is a perspective view of an unassembled, non-magnetic plate with an exposed pilot hole.
FIG. 4 is an exploded view of the integral polepiece RF amplification tube of FIG. 1.
FIG. 6 is a partial perspective view of an integral polepiece RF amplification tube for klystron operation.

Referring first to FIGS. 1 and 4, an RF amplification tube 10 according to the present invention is illustrated. The tube 10 is comprised of a laminate structure having a plurality of non-magnetic plates 18 and magnetic plates 16 (see FIG. 1) which are alternatingly assembled and integrally formed together. As seen in FIG. 1, the assembled tube 10 is elongated and generally rectangular, having end plates 12 disposed on either end, a first side 23, a second side 25 opposite the first side 23, a third side 27 and a fourth side 29 opposite the third side 27. As will be further described below, an electron beam provided in one end of the tube 10 would travel through a plurality of cavities formed within the TWT, and exit from an opposite end of the TWT.

Each of the magnetic plates 16 and non-magnetic plates 18 are generally rectangular. The preferred material for the magnetic plates 16 is iron, although other magnetic materials could be advantageously utilized. The magnetic plates 16, also known as polepieces, have a notch 22 disposed at an edge. The notch 22 shown in the drawings is generally rectangular, and extends less than halfway through the width of the polepiece. However, it is anticipated that alternative notch shapes, such as circular, be advantageously used as well as rectangular.

The notch position for each polepiece 16 could alternate between the edge corresponding with the first side 23 and the edge corresponding with the second side 25. As best shown in FIG. 4, the position of the notch 22 in polepiece $\mathbf{16}_1$ appears at the first side 23. The next polepiece $\mathbf{16}_2$ has a notch 22 disposed at the second side 25. The third polepiece $\mathbf{16}_3$ would again feature the notch 22 at the first side 23, similar to that of polepiece $\mathbf{16}_1$. Alternatively, the notch positions could all remain on a single side of the TWT 10, or could be a combination of the two configurations having a portion of the notches 22 disposed at the first side 23 and a portion disposed on the second side 25. In yet another embodiment, a single polepiece 16 could have more than one notch 22, such as one at both ends of the polepiece. As will be further described below, these notches will provide a coupling path for the neighboring cavities.

The non-magnetic plates 18 are adjacently positioned relative to the polepieces 16, and alternate with the polepieces. The preferred material for the non-magnetic plates 18 is copper, although other non-magnetic thermally conductive materials could be advantageously utilized. Each of the non-magnetic plates 18 has one or more internal slots 24. Each slot 24 has a generally parallelepiped shape, which extends fully through the plate 18 from the first edge 23 to the second edge 25. The slot 24 shape could also be oval in cross-section. Alternatively, the slot 24 could extend between the third side 27 and the fourth side 29. The slot direction could also alternate between a first direction extending between the first and second sides 23 and 25, and a second direction extending between sides 27 and 29. These slots 24 provide a tuned cavity 26.

It should be apparent from FIG. 4 that with the alternating polepieces 16 and non-magnetic plates 18 integrally formed together, there would be a continuous path through the tube 10 that passes through each cavity and crosses over each notch into an adjacent cavity. This path is also visible in the sectional drawing of FIG. 5.

Extending fully lengthwise through the tube 10 is an electron beam tunnel 14. The tunnel 14 is generally circular in shape and passes through each of the cavities 26, further linking the cavities. The beam tunnel provides a path for the projection of an electron beam through the completed coupled cavity tube 10. With the cavities 26 coupled by the notches 22 as described above, the tube 10 would function as a coupled cavity traveling wave tube amplifier. In operation, the electron beam interacts with an RF signal passing through the coupled cavities. Energy from the beam transfers to the RF signal, to increase the power of the RF signal.

Each of the polepieces 16 and the non-magnetic plates 18 have edges which are flush with the first side 23 and the second side 25. As will be further described below, the first side 23 and the second side 25 provide a planar surface 32, 32' for attachment of a heat sink 34 (see FIGS. 2 and 6). The third side 27 and fourth side 29 are flush with the other edges of each of the non-magnetic plates 18 and some of the polepieces 16. However, individual ones of the polepieces 16 extend outward from the third side 27 and the fourth side 29 to provide ears 36. The combination of the flush surface 38 (see FIG. 1) and the ears 36 provide a mounting position 38 for the installation of magnets 42. The magnets 42 as shown in FIG. 2 are substantially rectangular. However, other shapes of magnets, such as cylindrical, can be advantageously used.

As shown in FIG. 2, the magnets 42 are disposed within the mounting positions 38 relative to the TWT 10 so as to provide a magnetic field having flux lines 44 through the polepieces 16. The flux lines extend through the polepieces 16, jump across the non-magnetic plates 18 into the adjacent polepiece 16. The flux lines 44 also cross through the beam tunnel 14 to provide focusing for the electron beam. The magnetic flux lines 44 then jump across the space formed by the notch 22, back through the adjacent cavity 26 and into the first polepiece 16. It should be apparent that the heat sink surface 32 can be moved closer to the tunnel 14 by changing the shape of the slots 24 and the notches 22, therefore improving still further the heat handling ability of the tube 10. The polepieces 16 extend fully to the edge of the beam tunnel 14. It should be apparent, however, that the beam tunnel 14 may be provided with a thin coating of thermally conductive material, such as copper, to improve the thermal handling capability of the TWT 10. The coating would necessarily be thin enough so as not to disturb the magnetic flux path from the polepieces 16 to the beam tunnel 14.

Referring now to FIG. 6, there is an alternative embodiment in which the tube 10 can provide klystron operation. A portion of the magnetic plates 16 are provided without notches. As the electron beam passes through the tube 10, an electromagnetic field is formed within the cavities 26 which produces an RF signal. As known in the art, a portion of the cavities 26 can be coupled by the notches 22 to operate as an extended interaction output circuit for improved bandwidth.

To assemble an RF amplification tube 10 of the present invention, a laminate structure of generally rectangular, magnetic, and non-magnetic plates must be formed. Each of the magnetic and non-magnetic plates has a center alignment hole. A thin-walled molybdenum is inserted through each of the alignment holes, so that the alternating plates can be aligned together. Once the plates are assembled they are integrally formed together into the laminate structure by brazing or other joining technique. Each of the non-magnetic plates further has a pilot hole 52 extending from the edge associated with the first side 23 to the edge associated with the second side 25. An exemplary pilot hole 52 in an unassembled non-magnetic plate 18 is shown in FIG. 3. Once the structure of magnetic and non-magnetic plates are brazed together into an integral unit, the pilot holes 52 extend through a width of the structure and provide a mechanism for cutting out the cavities, as will be further described below. Alternatively, the laminate structure of magnetic and non-magnetic plates could be assembled and brazed together first, and the pilot hole 52 cut through the laminate structure afterward.

The next step is to reduce the exposed edges of the rectangular tube 10 into an approximate shape. It is anticipated that this be done through conventional milling techniques. Once the sides are squared off, the desired notches 22 are cut into the sides 23 and 25. The notches extend entirely across the width of the polepieces 16 and partially extend into each adjacent non-magnetic plate 18. As known in the art, the preferred cutting technique is dependent on the desired tolerance requirement.

After the notches 22 are formed, the cavities 26 can be cut out. The preferred method of cutting the cavities 26 is by using wire electron discharge machining (EDM). Under this technique, a wire is fed through the pilot holes 52 to cut away the undesired copper material, leaving the slot 24 without cutting through the cavity wall. This step is repeated to form each of the cavities 26 in the tube 10. After the cavities 26 are formed, a continuous path would result from the notches 22 which join the cavities 26.

The wire EDM technique is then used to square off the first side 23 and the second side 25, providing the heat sink surfaces 32, 32'. The wire EDM technique can also be used to remove side portions of the polepieces 16 and non-magnetic plates 18, leaving only the exposed ears 36. As desired, this last step can be performed to leave ears every three polepieces as shown in FIG. 1, or every two polepieces, as shown in FIG. 2. The molybdenum tube is also removed by the wire EDM technique, and the tool used to form the electron beam tunnel 14.

The final step in forming the tube 10 is to provide an entrance and exit port into each of the end plates 12. These ports provide for the RF signal to input into and output from the tube 10. The ports can also be formed with conventional milling or EDM techniques. The finished TWT 10 can then have heat sinks 34 affixed to the heat sink surfaces 32.

To put the integral polepiece RF amplification tube 10 into use, the tube must be assembled with other similar circuits into a complete amplifier assembly. A matching circuit can be added to the finished coupled cavity tube 10 to match the RF impedance between the RF input port and the tube itself. The matching circuit is typically machined into a portion of the coupled cavity tube 10. The tube 10 can then be assembled with other tube sections as shown in FIG. 7, to an electron gun 62 and an electron beam collector 64. The electron gun 62 has a cathode 63 which heats up to emit electrons. The electrons are focused into a beam 66 by the magnetic field provided in the beam tunnel 14 of the tube 10. The collector 64 receives and dissipates the electrons after they exit the tube 10. RF input and RF output terminals are provided for amplification of an RF signal.

It should be apparent to those skilled in the art, that the use of an RF amplification tube having a laminate structure and generally planar surfaces would be relatively inexpensive to construct. The copper plates which form the slots provide additional thermal ruggedness, by conducting heat from the beam tunnel to the heat sink. The desired geometry for the millimeter wave frequencies can be accurately obtained without tolerance build-up.

Since the magnetic field strength, B, on the edge of the electron beam is the prime consideration for focusing the electron beam, and an imperfect electron beam has a greater percentage of electron excursions at the outer radius of the electron beam, it would be advantageous to have a greater RMS axial magnetic field at the outer radius, than at the inner radius. This way, the weaker magnetic field at the center of the electron beam would cause more of the electron beam to have its equilibrium position moved closer to the beam tunnel wall. By moving more of the electrons of the electron beam to the outer radial position, enhanced electron interaction with the RF wave could be achieved over the prior art RF amplification tubes.

Greater variation in the magnetic field strength could be introduced in the beam tunnel 14 of the RF amplification tube 10 through selection of the ratio of polepiece spacing and beam hole diameter. Referring now to the cross section view of FIG. 5 (not drawn to scale), an RF amplification tube 10 is illustrated having a beam tunnel 14 with a diameter d and a separation P between centers of adjacent polepieces 16. As described above, prior art integral polepiece PPM focusing systems typically maintain a ratio of d/P of less than one. The inventors have found, however, that an RF amplification tube having a ratio of d/P of greater than one would yield increased axial magnetic field variation across the beam hole cross section, and thus greater gain and beam transmission.

Figure 8:
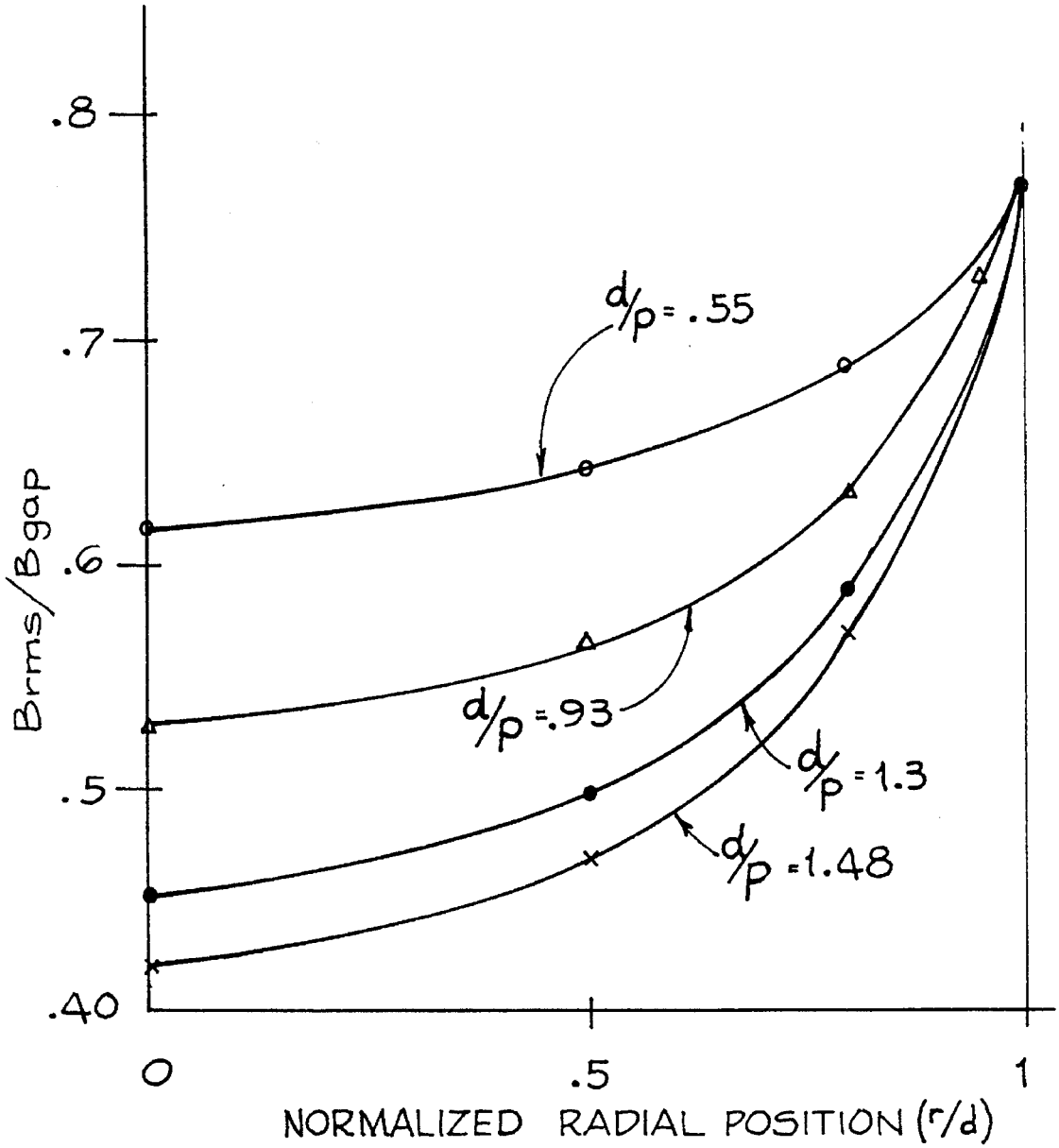
FIG. 8 is a graph illustrating a relationship between axial magnet field strength and normalized radial position for assorted PPM focusing systems.

Referring now to FIG. 8, a graph illustrating RMS magnetic field characteristics of a plurality of electron beams is illustrated. The ordinate of the graphs gives the ratio of the RMS magnetic field normalized to the field in the gap provided by the notches 22, illustrated as $B_{rms}/B_{gap}$. The abscissa of the graphs illustrates the normalized radial position of the beam, given by the ratio of r/d, where r is the radial position of the beam within the beam tunnel. Each of the graphs illustrate magnetic field characteristics for various values of d/P.

Considering first the uppermost curve, it should be apparent that very little variation in RMS axial magnetic field occurs across the normalized radial position of the electron beam. As the ratio of d/P increases, however the magnitude of RMS magnetic field variation increases substantially. As a result, a larger percentage of an electron beam will be found at the radial position of 0.6 (corresponding to the outermost radial position of an electron beam having a fill factor of 0.6) because the weaker magnetic field in the center of the beam will tend to shift electrons outward. Moreover, the beam will be focused more efficiently because the higher field at the wall of the beam tunnel 14 will tend to move the electrons inward.

Another advantage of this invention concerns the affect of the beam tunnel 14 with a diameter d on amplification. By decreasing the relative spacing P between adjacent polepieces, the normalized transverse wave number $\gamma a$ would increase above 2.2. While PPM focusing systems are typically inefficient as the normalized transverse wave number increases beyond this point, this invention has exhibited significant gain due to the variations of the axial magnetic field in a millimeter wave TWT having $\gamma a$ greater than 3.0.

Having thus described a preferred embodiment of a coupled cavity traveling wave tube for millimeter wave frequencies, it should now be apparent to those skilled in the art that the aforestated objects and advantages for the within system have been achieved. It should also be appreciated by those skilled in the art that various modifications, adaptations, and alternative embodiments thereof may be made within the scope and spirit of the present invention. For example, other precision cutting methods, such as milling or drilling, can be utilized instead of wire EDM. As known in the art, the dimensions of the components depend upon the frequency range of the RF signal to be amplified. These dimensions can be varied dramatically to provide for alternative RF frequency signals and RF levels.

Additionally, it should also be apparent that slots 24 could be provided in polepieces 16 as well as the non-magnetic plates 18, and that notches 22 could be provided in the non-magnetic plates as well as the polepieces, as desired to produce desired tube characteristics. Multiple slots 24 could also be formed in individual non-magnetic plates 18 or polepieces 16.

The present invention is further defined by the following claims:

What is claimed is:

1. An integral polepiece focusing structure for an RF amplification tube, comprising:

a slow-wave circuit comprising a plurality of magnetic polepieces and a plurality of electrically conductive non-magnetic plates which are alternatingly and integrally coupled into a laminate structure;

a means for inducing a magnetic field in said slow-wave circuit having lines of flux which flow through said magnetic polepieces; and a beam tunnel provided through said structure, said magnetic polepieces extending substantially entirely to said beam tunnel;

wherein a diameter of said beam tunnel is greater than a separation distance between adjacent ones of said polepieces.

2. The focusing structure of claim 1, wherein said magnetic field induced by said inducing means has an axial RMS value that varies substantially across a cross section of said beam tunnel.

3. An integral polepiece focusing structure for an RF amplification tube, comprising:

a slow-wave circuit comprising a plurality of magnetic polepieces and a plurality of electrically conductive non-magnetic plates which are alternatingly and integrally coupled into a laminate structure;

a means for inducing a magnetic field in said slow-wave circuit having lines of flux which flow through said magnetic polepieces; and a beam tunnel provided through said structure, said magnetic polepieces extending substantially entirely to said beam tunnel;

wherein a diameter of said beam tunnel is greater than a separation distance between adjacent ones of said polepieces;

wherein said non-magnetic plates each have a respective slot, said respective slots each providing a respective resonant cavity, said magnetic polepieces having a notch, said notches coupling said respective cavities.

4. The focusing structure of claim 3, wherein said beam tunnel intersects with said respective cavities.

5. An integral polepiece focusing structure for an RF amplification tube, comprising:

a slow-wave circuit comprising a plurality of magnetic polepieces and a plurality of electrically conductive non-magnetic plates which are alternatingly and integrally coupled into a laminate structure;

a means for inducing a magnetic field in said slow-wave circuit having lines of flux which flow through said magnetic polepieces; and a beam tunnel provided through said structure, said magnetic polepieces extending substantially entirely to said beam tunnel;

wherein a diameter of said beam tunnel is greater than a separation distance between adjacent ones of said polepieces;

wherein said magnetic field induced by said inducing means has an axial RMS value that varies substantially across a cross section of said beam tunnel;

wherein said axial RMS value of said magnetic field is greatest at an outermost portion of said beam tunnel.

6. An integral polepiece focusing structure for an RF amplification tube, comprising:

a slow-wave circuit comprising a plurality of magnetic polepieces and a plurality of electrically conductive non-magnetic plates which are alternatingly and integrally coupled into a laminate structure;

a means for inducing a magnetic field in said slow-wave circuit having lines of flux which flow through said magnetic polepieces; and a beam tunnel provided through said structure, said magnetic polepieces extending substantially entirely to said beam tunnel;

wherein a diameter of said beam tunnel is greater than a separation distance between adjacent ones of said polepieces;

wherein said slow-wave circuit has a plurality of sides, and further comprises a planar surface disposed on at least one of said plurality of sides of said slow-wave circuit, said planar surface having a heat sink attached thereto.

7. A focusing system for an electron beam within an RF amplification tube, comprising:

a plurality of magnetic polepieces each having a centrally disposed aperture;

a plurality of electrically conductive non-magnetic plates alternatingly and integrally provided with said polepieces, said non-magnetic plates each having a centrally disposed aperture, said apertures of said polepieces being aligned with said apertures of said non-magnetic plates to provide a beam tunnel;

at least one permanent magnet coupled to said polepieces, said magnet having magnetic flux which flows through said magnetic polepieces to provide an axial magnetic field within said beam tunnel;

wherein, a slow-wave circuit is provided within said polepieces and said non-magnetic plates that extends beyond a diameter of said beam tunnel, said diameter being greater than a separation distance between adjacent ones of said polepieces.

8. The focusing system of claim 7, wherein said axial magnetic field varies substantially across a cross section of said beam tunnel.

9. A focusing system for an electron beam within an RF amplification tube, comprising:

a plurality of magnetic polepieces each having a centrally disposed aperture;

a plurality of electrically conductive non-magnetic plates alternatingly and integrally provided with said polepieces, said non-magnetic plates each having a centrally disposed aperture, said apertures of said polepieces being aligned with said apertures of said non-magnetic plates to provide a beam tunnel;

at least one permanent magnet coupled to said polepieces, said magnet having magnetic flux which flows through said magnetic polepieces to provide an axial magnetic field within said beam tunnel;

wherein, a slow-wave circuit is provided within said polepieces and said non-magnetic plates that extends beyond a diameter of said beam tunnel, said diameter being greater than a separation distance between adjacent ones of said polepieces;

wherein said axial magnetic field varies substantially across a cross section of said beam tunnel;

wherein said axial magnetic field has a greatest RMS value at an outermost portion of said beam tunnel.

10. A focusing system for an electron beam within an RF amplification tube, comprising:

a plurality of magnetic polepieces each having a centrally disposed aperture;

a plurality of electrically conductive non-magnetic plates alternatingly and integrally provided with said polepieces, said non-magnetic plates each having a centrally disposed aperture, said apertures of said polepieces being aligned with said apertures of said non-magnetic plates to provide a beam tunnel;

at least one permanent magnet coupled to said polepieces, said magnet having magnetic flux which flows through said magnetic polepieces to provide an axial magnetic field within said beam tunnel;

wherein, a slow-wave circuit is provided within said polepieces and said non-magnetic plates that extends beyond a diameter of said beam tunnel, said diameter being greater than a separation distance between adjacent ones of said polepieces;

wherein at least one of said non-magnetic plates has a respective slot disposed therein, said respective slot providing a respective resonant cavity.

11. The focusing system of claim 10, wherein ones of said magnetic polepieces adjacent said at least one non-magnetic plate have a notch disposed therein, said notches coupling said respective cavity.

12. The focusing system of claim 11, wherein said beam tunnel intersects with said cavity.

* * * * *